US012025402B1

(12) United States Patent
Barnett et al.

(10) Patent No.: US 12,025,402 B1
(45) Date of Patent: Jul. 2, 2024

(54) BOWSTRING CARRIER TRAVERSE

(71) Applicants: David A. Barnett, Tarpon Springs, FL (US); James J. Kempf, Coralville, IA (US)

(72) Inventors: David A. Barnett, Tarpon Springs, FL (US); James J. Kempf, Coralville, IA (US)

(73) Assignee: BARNETT OUTDOORS, LLC, Tarpon Springs, FL (US)

( * ) Notice: Subject to any disclaimer, the term of this patent is extended or adjusted under 35 U.S.C. 154(b) by 0 days.

(21) Appl. No.: 18/595,684

(22) Filed: Mar. 5, 2024

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 9,958,232 | B1 * | 5/2018 | Egerdee | F41B 5/1403 |
| 10,126,088 | B2 * | 11/2018 | Yehle | F41B 5/105 |
| 10,690,436 | B1 | 6/2020 | Kempf et al. | |
| 11,015,892 | B1 * | 5/2021 | Jessup | F41A 17/20 |
| 11,221,191 | B2 * | 1/2022 | Bednar | F41B 5/1469 |
| 11,236,963 | B2 * | 2/2022 | Bednar | F41B 5/1469 |
| 11,874,085 | B2 * | 1/2024 | Barnett | F41B 5/14 |

* cited by examiner

*Primary Examiner* — John A Ricci
(74) *Attorney, Agent, or Firm* — Donald J. Ersler

(57) ABSTRACT

A projectile launching device having a bowstring carrier operably coupled with a bowstring carrier traverse assembly. The bowstring carrier traverse assembly having a motor operable with a spool and a connecting component, wherein when the bowstring is not retaining a bowstring and the bowstring carrier is in the cocked position, the traverse assembly selectively returns the bowstring carrier to the at-rest position.

3 Claims, 4 Drawing Sheets

BOWSTRING CARRIER TRAVERSE

BACKGROUND OF THE INVENTION

1. Field of the Invention

The present invention relates generally to archery and more specifically to a bowstring carrier traverse.

2. Discussion of the Prior Art

Historically, crossbows have had a bowstring operably coupled to bow limbs, and some type of trigger and bowstring retain-release mechanism. The user would transition the bowstring from an at-rest, or un-cocked position to a cocked position. This has been accomplished in many ways, some with great success. More recently, the use of an actual bowstring carrier assembly to transition the bowstring from the at-rest position to the cocked position and retain the bowstring in the cocked position were introduced. However, there was no way to readily move this bowstring carrier assembly from the cocked position to the un-cocked position once the crossbow had been fired. The user had to manually move the bowstring carrier, and depending on the configuration of the crossbow, this could be quite difficult.

Until recently there has not been an easy, cost-effective way to achieve this. One method was invented by Kempf et. al. in U.S. Pat. No. 10,690,436, which is herein incorporated in its entirety and wherein twin lead screws were attached to the bowstring carrier to both cock and de-cock the crossbow, as well as to move the carrier from the cocked position to an at rest position after the crossbow had been shot. Though very effective, this mechanism is quite complex and expensive to produce, and requires manual or motorized operation by the user. More recently, U.S. Pat. No. 11,874,085 to Barnett Outdoors, which is herein incorporated in its entirety discloses an internally powered unit with a clock spring and a high pitch leadscrew to move the bowstring carrier from the cocked position to the at-rest position once the crossbow was fired. However, this device was also quite elaborate, and required many additional parts to manufacture, and a complex inner structure to house the components.

Accordingly, there is a clearly felt need in the art for a bowstring carrier traverse, which includes fewer components than that of the prior art.

SUMMARY OF THE INVENTION

For the present invention, a projectile launching device (PLD) will be described as a device that is generally known as a crossbow, however it may also be referred to as any device that propels an arrow with the use of store energy, with the exception of compressed air or a propellant. A PLD may be any device known in the art that selectively retains stored energy and selectively releases stored energy to propel an arrow, however the application may also be referred to as a crossbow. A bowstring carrier shall be defined as a component or assembly that is utilized to facilitate the transition of the bowstring from the at-rest position to the cocked position, and may be referred herein as a carrier. A bowstring retainer shall be defined as a component or assembly that selectively retains or releases the bowstring from the bowstring carrier, and may be referred to as a latch. A bowstring carrier retainer shall be defined as a component or assembly that selectively retains and releases the bowstring carrier from the cocked position, and may be referred to herein as a carrier release.

There is a long felt need in the art to have a string carrier traverse mechanism having fewer parts; easy to manufacture and assemble; cost effective to manufacture; adds little weight to the crossbow; and is very compact.

The preferred embodiment of the present invention is a string carrier traverse mechanism that translates a string carrier from a cocked position to a bowstring at-rest position on a crossbow or PLD. The string carrier may be of simple or complex design, in that it may simply consist of a component that engages the bowstring and retains it while transitioning from the at-rest position to the cocked position, or of a complex design wherein the string carrier would consist of a latch, sear, safety, anti-dryfire device, springs and so on.

In its simplest form, the preferred embodiment of a bowstring carrier traverse may be manufactured with as few as 3 components: a connecting component such as a strap, ribbon, or chord; a winding surface such as a spool; and an energy component such as a clock spring or constant force spring (spring). The spring having a first end in a fixed position, and the second end coupled with the spool. The first end of the connecting component is fixed with the spool adjacent the winding surface, and a second end of the connecting component is operably coupled with the bowstring carrier. In the preferred embodiment, the second end of the spring is operably coupled with an interior surface of the spool, and the spool surrounds the spring axially, and the spool is in a vertical configuration. The first end of the spring is operably fixed with the PLD.

The connecting component is wound about the winding surface when the bowstring carrier is adjacent the bowstring in the at-rest position. Once the bowstring is retained by the string carrier, the user initiates the cocking procedure by any method known in the art, including a rope cocker, a crank cocker or any other suitable device. The bowstring carrier and the bowstring transition from the at-rest position to the cocked position by the connecting component unwinds from the spool winding surface, rotating the spring, thus storing energy within the spring. Once cocked, the string carrier is engaged by a retainer.

Once the crossbow has been fired, the user selectively disengages the retainer, and stored energy in the spring causes the connecting component to wind about the winding surface of the spool, automatically returning the bowstring carrier to the bowstring at-rest position.

Accordingly, it is an object of the present invention to provide a bowstring carrier traverse, which includes fewer components than that of the prior art.

These and additional objects, advantages, features and benefits of the present invention will become apparent from the following specification.

DETAILED DESCRIPTION OF THE INVENTION

Figure 1:
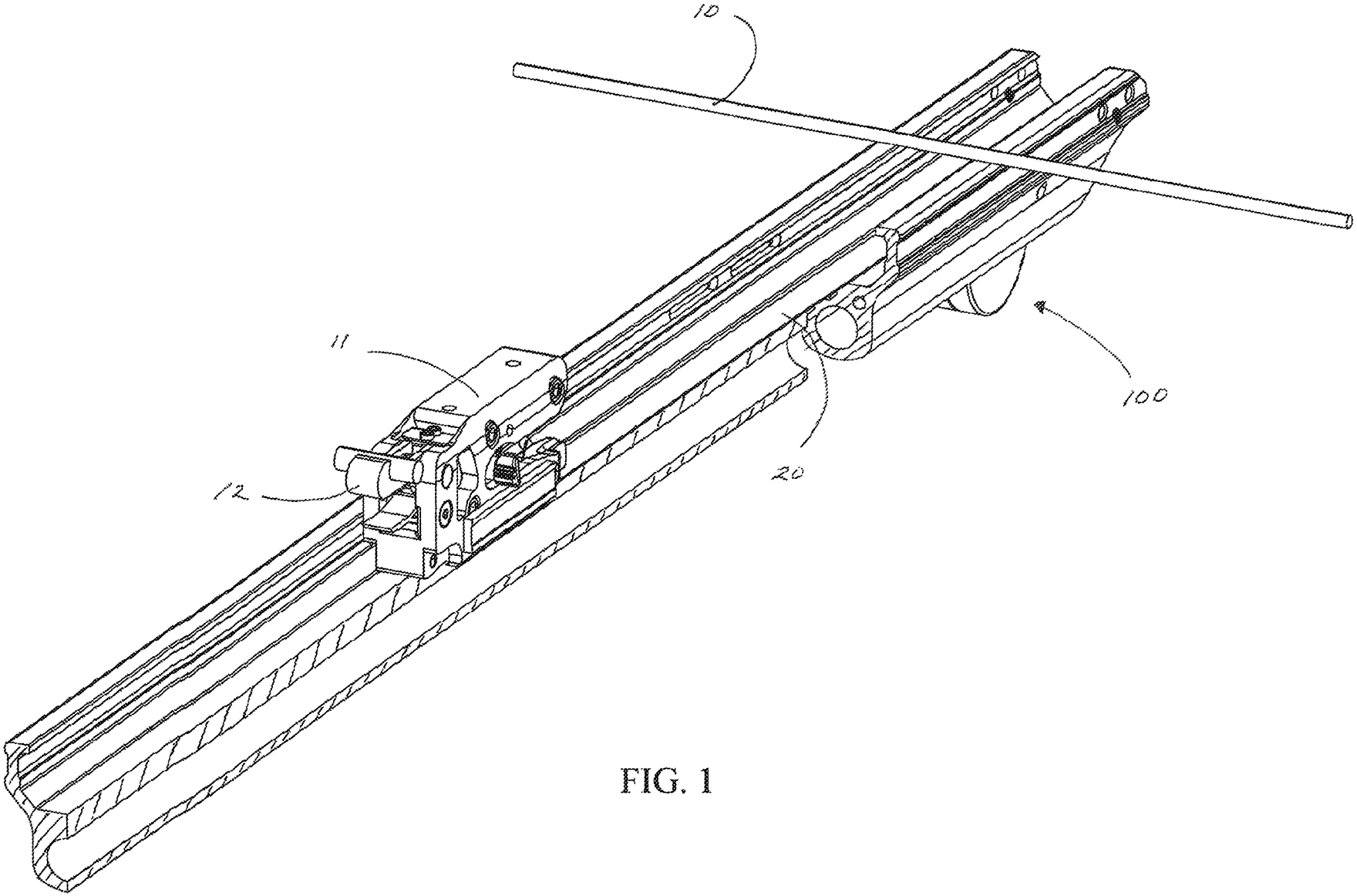
FIG. 1 is a perspective cutaway view of a crossbow rail with a bowstring carrier traverse assembly attached thereto and a bow string carrier slidably engaged with the bowstring rail in accordance with the present invention.
Figure 2:
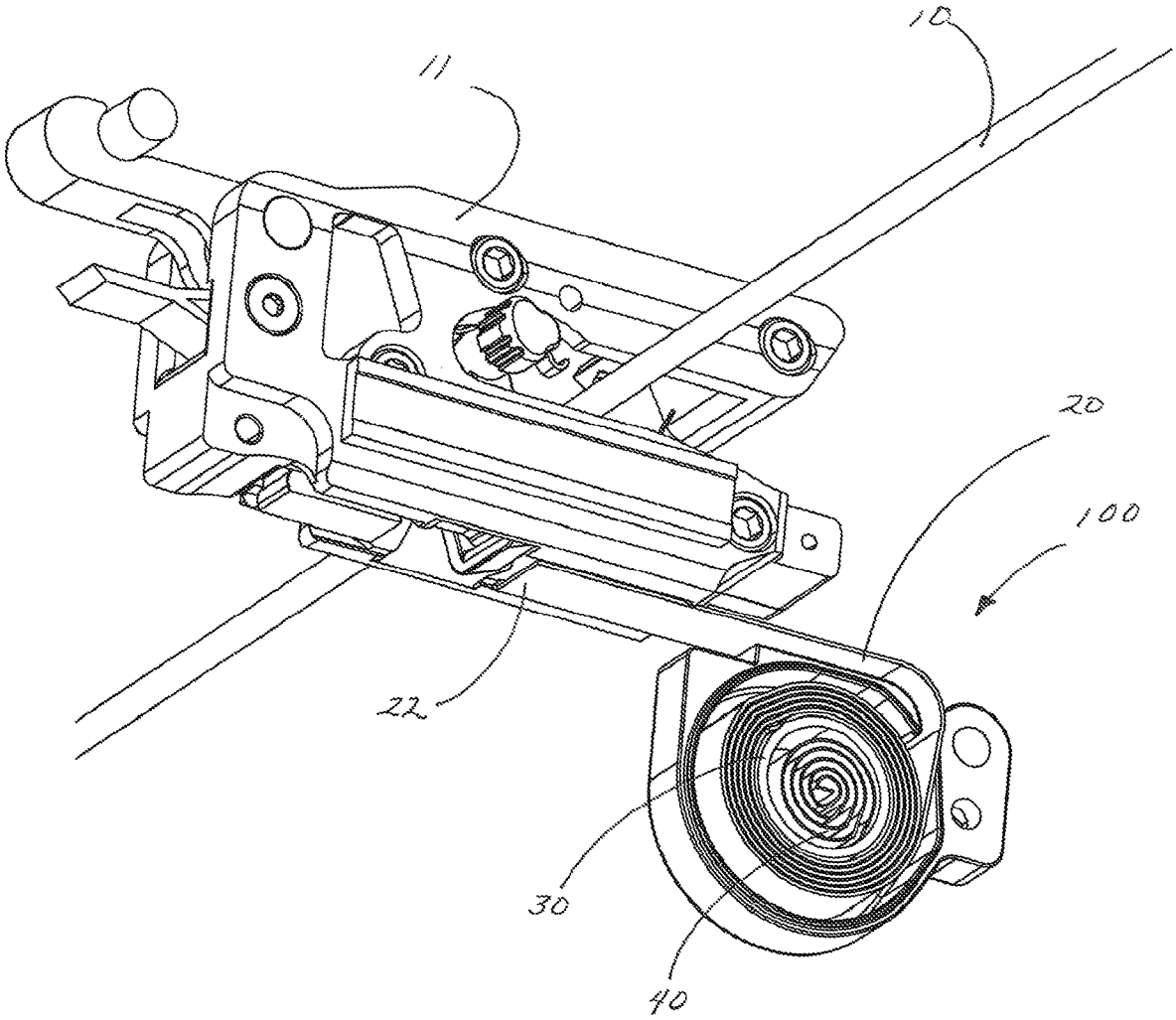
FIG. 2 is a bottom perspective view of a bow string carrier and a second end of a connecting component of a bowstring carrier traverse assembly engaged with a bottom of the bow string carrier in accordance with the present invention.
Figure 3:
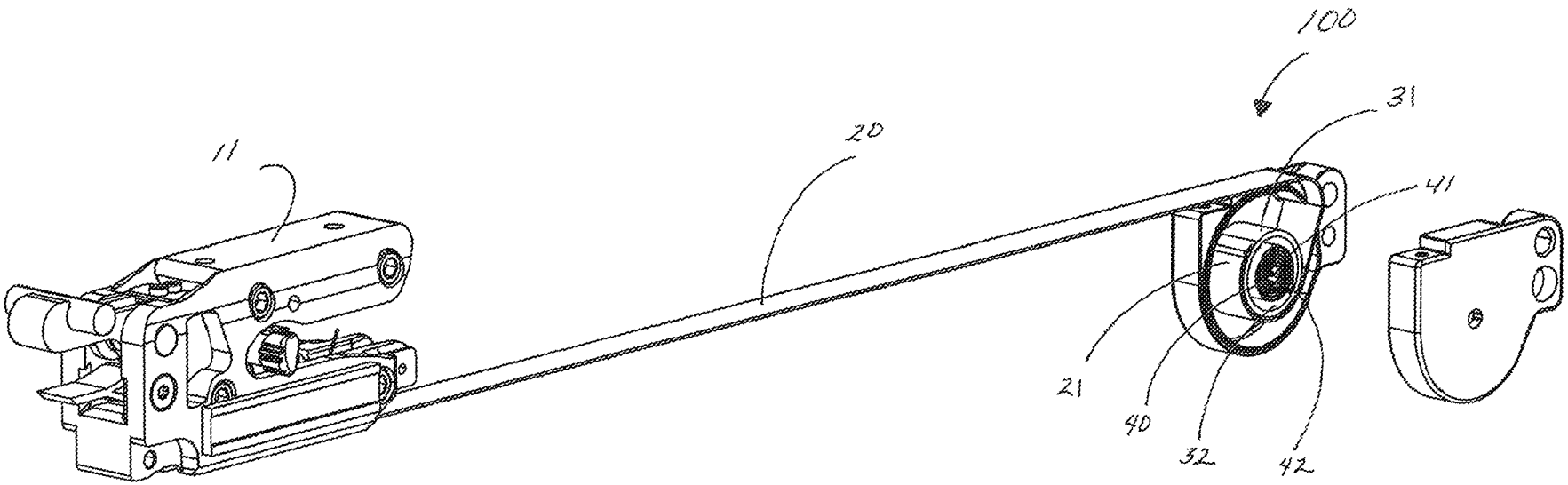
FIG. 3 is a partially exploded perspective view of a bow string carrier and a second end of a connecting component of a bowstring carrier traverse assembly engaged with a bottom of the bow string carrier with the connecting component unwound in accordance with the present invention.
Figure 4:
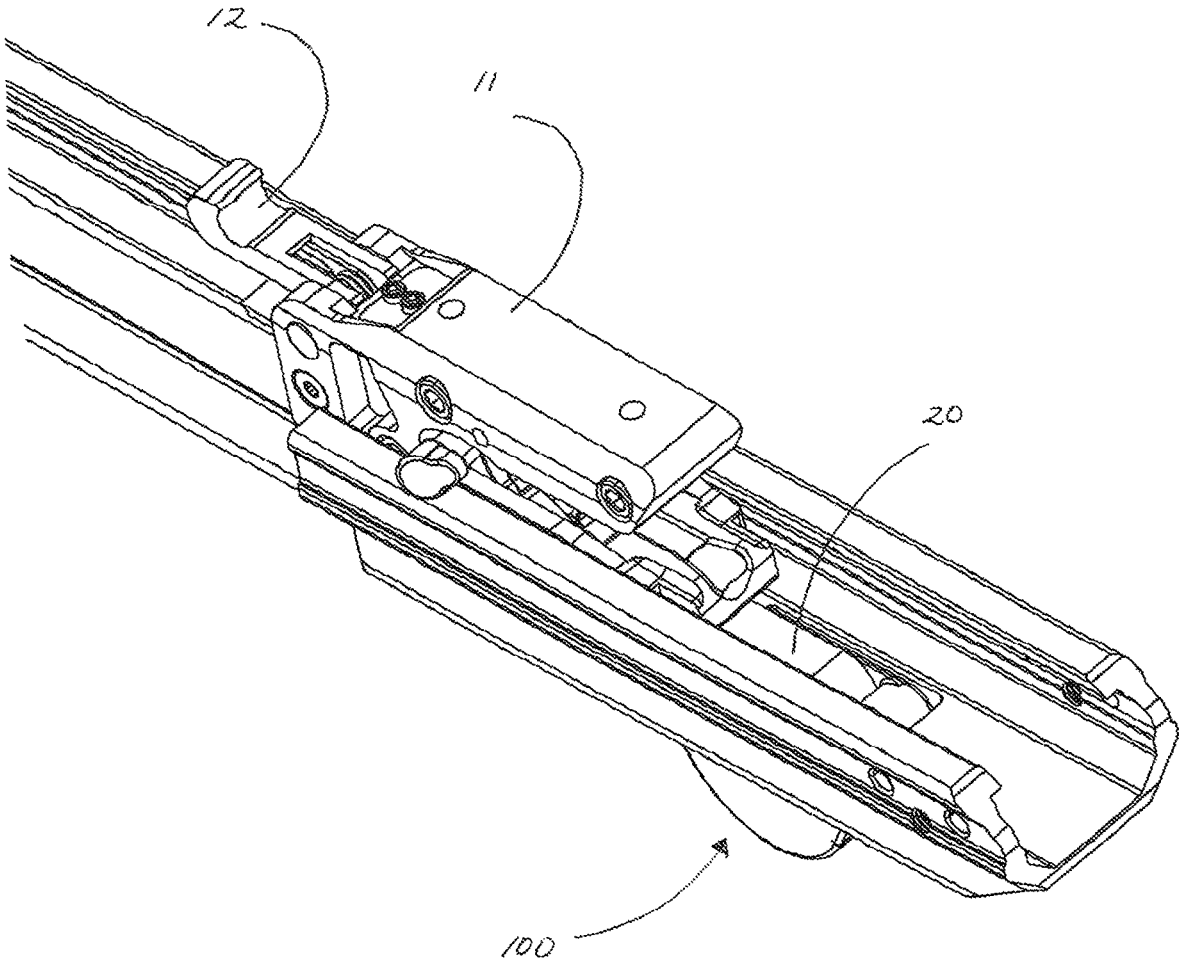
FIG. 4 is a perspective view of a bowstring carrier slidably retained in a slot of a crossbow rail with a bowstring carrier traverse assembly attached to the bowstring rail in accordance with the present invention.

The preferred embodiment of the invention details a bowstring carrier traverse assembly 100 of a crossbow (crossbow as defined above). The crossbow includes at least a bowstring 10, a bowstring carrier 11 and bowstring carrier retainer 12. The bowstring carrier traverse assembly 100 is operably coupled with the crossbow. The bowstring carrier traverse assembly 100 includes a connecting component 20, a spool 30, and a spring motor 40. The connecting component 20 includes a first end 21 and a second end 22.

The spool 30 has an outer winding surface 31 and an inner surface 32. The spring motor 40 has a first end 41 and a second end 42. A first end 21 of the connecting component 20 is operably coupled with the winding surface 31 of the spool 30, and the second end 22 of the connecting component is operably coupled with the bowstring carrier 11.

The first end 41 of the spring motor 40 is operably coupled with the crossbow and the second end 42 of the spring motor 40 is operably coupled with the inner surface 32 of the spool 30.

There are three static configurations of the crossbow; Configuration ONE: un-cocked; Configuration TWO: cocked; and Configuration THREE: fired.

ONE: When the crossbow is in the un-cocked configuration, the bowstring 10 is at rest (distal position), and the bowstring carrier 11 is adjacent the bowstring 10 and retains the bowstring 10; the connecting component 20 is wrapped about the winding surface 31 of the spool 30, and there is minimal energy stored in the spring motor 40.

TWO: When the crossbow 1 is in the cocked position, the bowstring carrier 11 is adjacent the bowstring 10 in the cocked position (proximal position), the connecting component 20 is unwound from the spool 30, and there is maximum energy stored in the spring motor 40.

THREE: When the crossbow is in the fired configuration, the bowstring 10 is in the at-rest distal position, the bowstring carrier 11 is still in the proximal position and retained by the bowstring carrier retainer 12, the connecting component 20 is still unwound from the spool 20, and maximum energy is still stored in the spring motor 40.

In use of Configuration ONE, a cocking force is applied to the crossbow 1, the bowstring carrier 11 retains the bowstring 10 and transitions the bowstring 10 from the at-rest distal position to the cocked proximal position. The connecting component 20 unwinds from spool 30, storing energy in the spring motor 40. The bowstring carrier retainer 12 may be automatically or manually engaged to retain the bowstring carrier in the proximal position.

In use of Configuration THREE, once the user has fired the crossbow 1, the bowstring 10 is in the at-rest distal position, the bowstring carrier 11 is still in the proximal position and retained by the bowstring carrier retainer 12, the connecting component 20 is still unwound from the spool 20, and maximum energy is still stored in the spring motor 40. The user disengages the bowstring carrier retainer 12 from the bowstring carrier 11, stored energy in the spring motor 40 rotates the spool 30, winding the connecting component 20 about the spool winding surface 31, translating the bowstring carrier 11 from the proximal to the distal position adjacent the bowstring 10. The functional characteristics of the practice of the invention may allow for automatic engagement and retainment of the bowstring carrier 11 with the bowstring 10 or for the manual engagement and retainment of the bowstring carrier 11 with the bowstring 10. 9

Though the preferred embodiment has been disclosed herein, there are many similar ways that a spring motor may be used to enable a connecting component to transition a bowstring carrier from a retained position to a bowstring at-rest position. Other embodiments may include the spring motor being adjacent the spool, above or below the spool; the spool may be in a horizontal or angular configuration. An alternative embodiment may automatically retain the bowstring with the bowstring carrier. Another embodiment may locate the traverse mechanism between the retained position and the bowstring at rest position. This configuration could use a smaller mechanism; shorter spring and connecting component would require a much smaller assembly. The string carrier would be transitioned automatically halfway, and the user would manually transition the string carrier to the bowstring. This alternative embodiment would allow for greater design flexibility of the PLD.

Alternate embodiments could also include the use of other motors, such as electric, air, etc. to cause the rotation of a winding surface to wrap a connecting component, to move a string carrier from a proximal position to a distal position.

The invention claimed is:

1. A projectile launching device comprising:

a bowstring, a bowstring carrier, a bowstring carrier retainer and a bowstring carrier traverse assembly;

the bowstring operably coupled with energy storing components throughout a draw cycle and a release cycle, the bowstring is selectively retained within the bowstring carrier and transitions from an at-rest position to a cocked position during the draw cycle;

the bowstring carrier traverse assembly includes a connecting component, a winding surface, and a spring motor, a first end of the connecting component operably coupled to the winding surface and a second end operably coupled to the bowstring carrier, and the spring motor operably coupled with the winding surface to bias the bowstring carrier toward the bowstring at-rest position; the assembly having a wound configuration, wherein the connecting component is wound about the winding surface and an unwound configuration, wherein the connecting component is unwound from the winding surface;

the assembly operably coupled with the projectile launching device;

the bowstring carrier assembly having at least a bow string retainer, wherein the bow string carrier is operably coupled with the second end of connecting component and is slidingly engaged with the projectile launching device, the bowstring carrier capable of retaining the bowstring during the draw cycle and being retained in the cocked position; and a cocking mechanism operable with the bowstring carrier translates the bowstring and bowstring carrier from the at-rest position to the cocked position, such that the connecting component unwinds from the winding surface, energy is stored in the spring motor, wherein subsequent release of the bowstring and projectile, upon the selectable release of the bowstring carrier, the spring motor releases stored energy resulting in the winding of the connecting component about the winding surface translating the bowstring carrier from the cocked position to the at rest position.

2. The projectile launching device of claim 1 wherein:

the spring motor having adequate force to automatically engage the bowstring retainer within the bowstring carrier upon return of the bowstring carrier to the at-rest position.

3. A projectile launching device comprising:

a bowstring, a bowstring carrier, a bowstring carrier retainer and a bowstring carrier traverse assembly;

the bowstring operably coupled with energy storing components throughout a draw cycle and a release cycle, the bowstring is selectively retained within the bowstring carrier and transitions from an at-rest position to a cocked position during the draw cycle;

the bowstring carrier traverse assembly comprising at least a connecting component, a winding surface, and a motor, a first end of the connecting component operably coupled to the winding surface and a second end operably coupled to the bowstring carrier, and the motor operably coupled with the winding surface to bias the bowstring carrier toward the bowstring at-rest position;

the assembly having a wound configuration, wherein the connecting component is wound about the winding surface and an unwound configuration wherein the connecting component is unwound from the winding surface;

the assembly operably coupled with the projectile launching device;

the bowstring carrier assembly having at least a bow string retainer, wherein the bow string carrier is operably coupled with the second end of connecting component and is slidingly engaged with the projectile launching device; the bowstring carrier capable of retaining the bowstring during the draw cycle and being retained in the cocked position; and a cocking mechanism operable with the bowstring carrier translates the bowstring and the bowstring carrier from the at-rest position to the cocked position, such that the connecting component unwinds from the winding surface, wherein subsequent the release of the bowstring and projectile, upon selectable release of the bowstring carrier, the motor winds the connecting component about the winding surface translating the bowstring carrier from the cocked position to the at-rest position.

* * * * *